US008794194B2

(12) United States Patent
Takiguchi

(10) Patent No.: US 8,794,194 B2
(45) Date of Patent: Aug. 5, 2014

(54) COMBUSTION STATE CONTROL APPARATUS

(71) Applicant: Suzuki Motor Corporation, Shizuoka (JP)

(72) Inventor: Shinya Takiguchi, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 13/768,155

(22) Filed: Feb. 15, 2013

(65) Prior Publication Data

US 2013/0220241 A1 Aug. 29, 2013

(30) Foreign Application Priority Data

Feb. 24, 2012 (JP) ..... 2012-038506

(51) Int. Cl.
*F01P 7/14* (2006.01)

(52) U.S. Cl.
USPC ..... 123/41.08; 701/51; 477/107

(58) Field of Classification Search
CPC ..... F01P 11/16; F01P 3/20; F01P 7/12; F01P 7/167; F01P 7/16; B60W 10/06; F16H 1/0213; F16H 2200/0008; F16H 2200/0013; F16H 2200/0017; F16H 2200/0021
USPC ..... 123/41.01, 41.02, 41.05, 41.08, 41.13, 123/41.15, 406.11–406.76; 477/107; 701/51, 55
See application file for complete search history.

(56) References Cited

U.S. PATENT DOCUMENTS

| | | | | |
|---|---|---|---|---|
| 4,566,354 | A * | 1/1986 | Kumura et al. | 477/48 |
| 4,807,495 | A * | 2/1989 | Wallace | 477/98 |
| 6,223,700 | B1 * | 5/2001 | Sano et al. | 123/41.1 |
| 7,247,124 | B2 * | 7/2007 | Tamai | 477/115 |

FOREIGN PATENT DOCUMENTS

| | | | | |
|---|---|---|---|---|
| JP | 63235750 | A * | 9/1988 | F16H 5/66 |
| JP | 11-324775 | A | 11/1999 | |

* cited by examiner

*Primary Examiner* — Hung Q Nguyen
(74) *Attorney, Agent, or Firm* — Rothwell, Figg, Ernst & Manbeck, P.C.

(57) ABSTRACT

An ECU includes: an electronically controlled valve opening degree control unit for increasing the opening degree of an electronically controlled valve, as a temperature of a coolant detected by a water temperature detecting unit is higher; and a gear ratio control unit for changing the gear ratio of an automatic transmission to a gear ratio to be used when a vehicle runs at a slow speed, when the temperature of the coolant detected by the water temperature detecting unit is equal to or higher than a temperature when the electronically controlled valve opening degree control unit sets the opening degree of the electronically controlled valve to be a maximum opening degree, and when an engine speed detected by an engine speed detecting unit is slower than a preset engine speed and a load to an engine detected by a load detecting unit is larger than a preset load.

7 Claims, 5 Drawing Sheets

COMBUSTION STATE CONTROL APPARATUS

CROSS-REFERENCE

This document claims priority to Japanese Application Number 2012-038506, filed Feb. 24, 2012, the entire content of which is hereby incorporated by reference.

TECHNICAL FIELD

The present invention relates to a technology of controlling a combustion state of an internal combustion engine of a vehicle, and more specifically, to a technology suitable for suppressing an occurrence of an abnormal combustion like knocking.

BACKGROUND ART

When an engine runs in a slow engine speed, the moving speed of a piston is slow, which does not likely to cause a turbulence of an air-fuel mixture in a combustion chamber. This slows the flame propagation speed of the air-fuel mixture ignited by a spark plug. In the case of a high-load condition, the output generated by an engine becomes larger than the case of a low-load condition. In this case, the amount of intake air introduced into the combustion chamber becomes large. The larger the amount of intake air is, the more the spontaneous ignition is likely to occur due to the compression by the piston. In such a case, the air-fuel mixture is spontaneously ignited before the flame of the air-fuel mixture ignited by the spark plug propagates.

Patent Document 1 discloses a technology focusing on such a problem.

In the technology disclosed in Patent Document 1, whether or not a state that causes an abnormal combustion occurs based on an intake pressure, an engine temperature, an engine speed, and an air-fuel ratio. When determining that the abnormal combustion will occur, the closing angle of an intake valve is retarded to decrease the charging efficiency to the combustion chamber, thereby suppressing an abnormal combustion.

PRIOR ART DOCUMENT

Patent Document

Patent Document 1: JP H11-324775 A

SUMMARY OF THE INVENTION

Problem to be Solved

According to the technology disclosed in Patent Document 1, however, since the charging efficiency to the combustion chamber is decreased in order to suppress an abnormal combustion, the engine efficiency may also decrease.

Hence, it is an object of the present invention to suppress beforehand a transition to an engine running condition that is likely to cause an abnormal combustion, and to suppress a transition to a control that decreases the engine efficiency in order to suppress an abnormal combustion.

Solution to the Problem

To accomplish the above object, according to an aspect of the present invention, there is provided a combustion state control apparatus for controlling a combustion state of an internal combustion engine of a vehicle having the internal combustion engine, an automatic transmission capable of automatically changing a gear ratio, a radiator in which a coolant flowing through the internal combustion engine to circulate to lower a temperature of the coolant, a flow rate adjusting unit for adjusting a flow rate of the coolant to the radiator, a coolant temperature detecting unit for detecting the temperature of the coolant, an engine speed detecting unit for detecting an engine speed of the internal combustion engine, and a load detecting unit for detecting a load of the internal combustion engine, the combustion state control apparatus comprising: an opening degree adjusting unit for increasing an opening degree of the flow rate adjusting unit, as the temperature of the coolant detected by the coolant temperature detecting unit is higher; and a gear ratio changing unit for changing the gear ratio of the automatic transmission to the gear ratio to be used when the vehicle runs at a slow speed, when the temperature of the coolant detected by the coolant temperature detecting unit is equal to or higher than a temperature when the opening degree adjusting unit sets the opening degree of the flow rate adjusting unit to be a maximum opening degree, the engine speed of the internal combustion engine detected by the engine speed detecting unit is slower than a preset engine speed, and the load to the internal combustion engine detected by the load detecting unit is larger than a preset load.

In the above configuration, the automatic transmission may comprise a plurality of transmission mechanisms, and the gear ratio changing unit changes respective gear ratios of the plurality of transmission mechanisms to the gear ratios to be used when the vehicle runs at a slow speed.

Advantageous Effects of the Invention

According to the above aspect of the present invention, the flow rate of the coolant to the radiator is adjusted to cause the internal combustion engine to have a temperature that does not likely to cause an abnormal combustion of the internal combustion engine. Hence, according to the aspect of the present invention, it becomes possible to prevent beforehand the internal combustion engine from becoming a running condition that easily causes an abnormal combustion. Therefore, according to the aspect of the present invention, an abnormal combustion can be suppressed without the necessity of a control that decreases the engine efficiency to suppress an abnormal combustion. An example control that decreases the engine efficiency is a control of decreasing the charging efficiency to the combustion chamber, etc.

Moreover, according to the above aspect of the present invention, when the temperature of the internal combustion engine cannot be maintained to a temperature that suppresses an abnormal combustion by an adjustment of the flow rate of the coolant, the gear ratio of the automatic transmission is changed to a gear ratio to be used when the vehicle runs at a slow speed so as to increase the engine speed of the internal combustion engine and to suppress an abnormal combustion.

At this time, according to the above aspect of the present invention, the gear ratio of the automatic transmission is changed under the condition in which the engine speed of the internal combustion engine is slower than a preset engine speed and the load of the internal combustion engine is larger than a preset load. Accordingly, it becomes possible to suppress an improper gear-ratio change of the automatic transmission, and an improper increase of the engine speed of the internal combustion engine. Hence, according to the aspect of the present invention, it becomes possible to prevent a driver or a passenger from feeling strangeness due to the improper increase of the engine speed of the internal combustion engine.

According to the above aspect of the present invention, respective gear ratios of multiple transmission mechanisms are changed to the gear ratios to be used when the vehicle runs at a slow speed. This expands the variation range of the automatic transmission, and the internal combustion engine can have a leeway in the increase of the engine speed. Hence, according to the aspect of the present invention, in comparison with a case where the automatic transmission changes the gear ratio through one transmission mechanism, the engine speed of the internal combustion engine can be increased largely, thereby surely suppressing an abnormal combustion.

DESCRIPTION OF EMBODIMENTS

An explanation will now be given of the present embodiment of the present invention with reference to the accompanying drawings.

The present embodiment relates to a vehicle provided with an engine combustion state control apparatus.

(Configuration)

Figure 1:
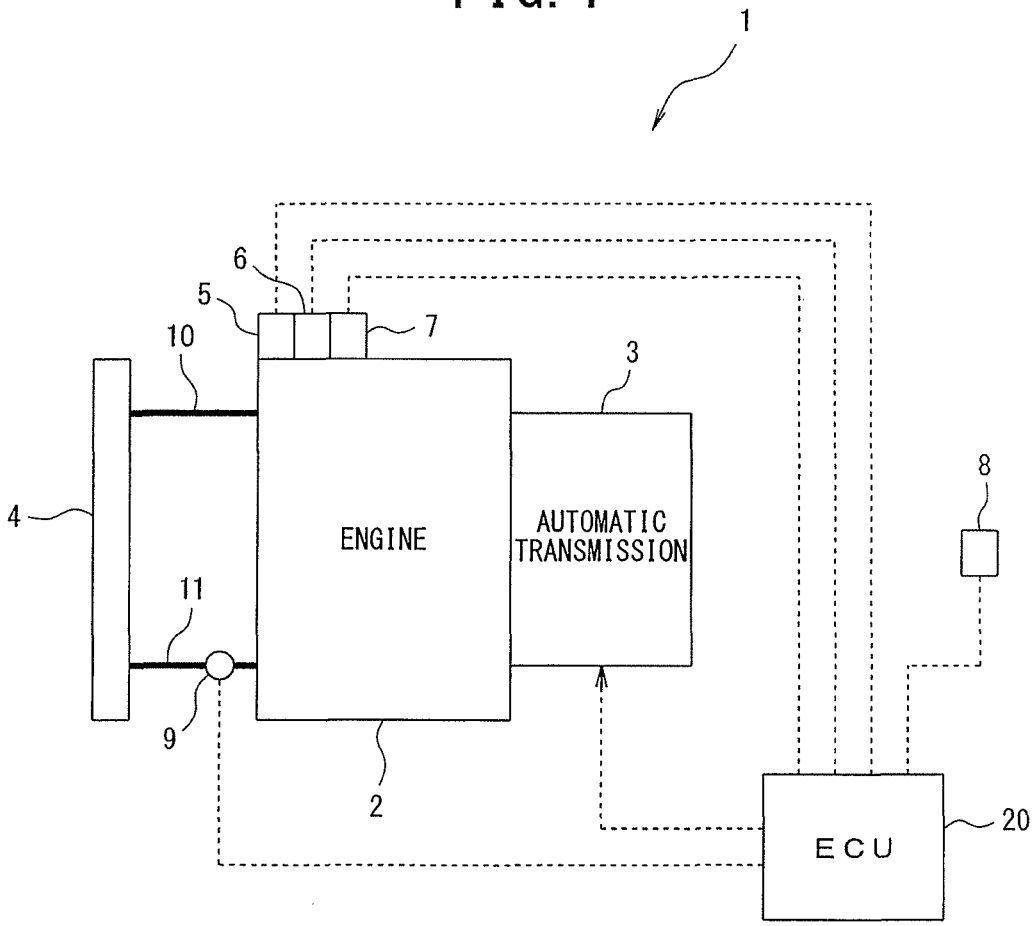
FIG. 1 is a diagram illustrating a configuration example of a vehicle provided with an engine combustion state control apparatus according to an embodiment of the present invention.

FIG. 1 is a diagram illustrating a configuration example of a vehicle 1 according to the present embodiment.

The vehicle 1 includes an engine 2, an automatic transmission 3, and a radiator 4. Moreover, the vehicle 1 includes a water temperature detecting unit 5, an engine speed detecting unit 6, a load detecting unit 7, an accelerator opening degree detecting unit 8, an electronically controlled valve 9, and an ECU (Electronic Control Unit) 20.

The automatic transmission 3 is capable of automatically changing the gear ratio. For example, the automatic transmission 3 automatically changes the gear ratio in accordance with a vehicle speed and an engine speed. The automatic transmission 3 may be a multistage transmission or a continuously variable transmission (CVT), etc., and is not limited to any particular type.

The water temperature detecting unit 5 is mounted on the engine 2 and detects a temperature of engine coolant. Next, the water temperature detecting unit 5 outputs a detected engine coolant temperature to the ECU 20 that is a control device. The engine speed detecting unit 6 is mounted on the engine 2, and detects an engine speed. Next, the engine speed detecting unit 6 outputs a detected engine speed to the ECU 20. The load detecting unit 7 is mounted on the engine 2, and detects an engine load applied to the engine 2. Then, the load detecting unit 7 outputs a detected engine load to the ECU 20. In addition, the accelerator opening degree detecting unit 8 detects an accelerator opening degree (an accelerator pedal press-down degree or a throttle opening degree). The accelerator opening degree detecting unit 8 outputs a detected accelerator opening degree to the ECU 20.

The radiator 4 is connected to the engine 2 through a coolant outlet piping 10 and a coolant inlet piping 11. The radiator 4 cools down the engine coolant circulating between the radiator 4 and the engine 2. The electronically controlled valve 9 is built in, for example, the coolant inlet piping 11. The electronically controlled valve 9 adjusts the flow rate of the engine coolant in the coolant inlet piping 11. According to the present embodiment, it is appropriate as long as the flow rate of the engine coolant into the radiator 4 can be adjusted by the electronically controlled valve 9. Hence, the electronically controlled valve 9 may be disposed in the coolant outlet piping 10. Alternatively, the electronically controlled valve 9 may be disposed in any other location as long as the flow rate of the engine coolant into the radiator 4 can be adjusted. The electronically controlled valve 9 is, for example, a coolant control valve, an electronically controlled thermostat, or a heater shut-off valve. The opening degree of the electronically controlled valve 9 is controlled by the ECU 20.

The ECU 20 is a controller that includes a microcomputer and peripheral circuits thereof. The ECU 20 includes, for example, a CPU, a ROM, and a RAM, etc. The ROM stores one or more programs that realize various processes. The CPU carries out various processes in accordance with such one or more programs stored in the ROM.

Figure 2:
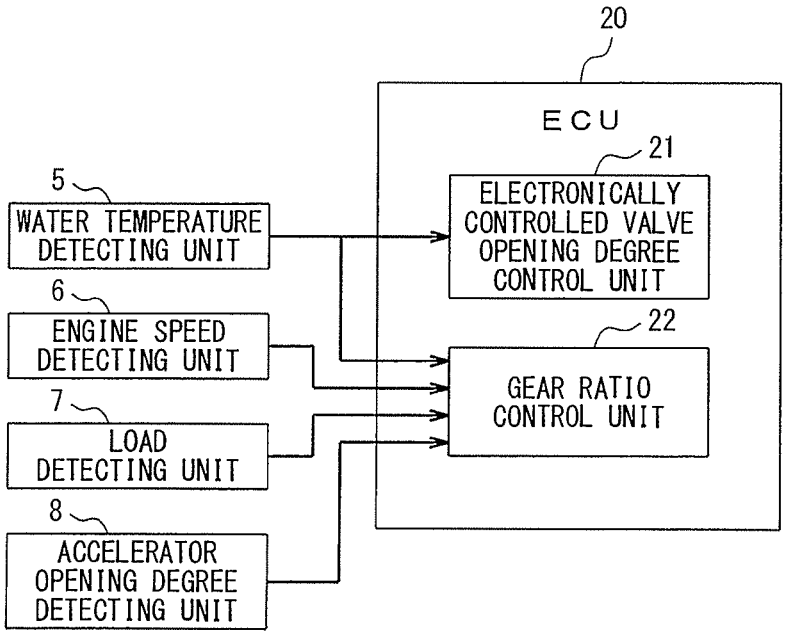
FIG. 2 is a diagram illustrating a configuration example of an ECU.

FIG. 2 is a diagram illustrating an illustrative configuration of the ECU 20.

As illustrated in FIG. 2, the ECU 20 includes an electronically controlled valve opening degree control unit 21 and a gear ratio control unit 22.

The electronically controlled valve opening degree control unit 21 controls the opening degree of the electronically controlled valve 9 in accordance with the temperature of the engine coolant detected by the water temperature detecting unit 5. More specifically, the higher the temperature of the engine coolant is, the more the electronically controlled valve opening degree control unit 21 increases the opening degree of the electronically controlled valve 9. Hence, the higher the temperature of the engine coolant is, the larger the flow rate of the engine coolant becomes which circulates between the engine 2 and the radiator 4. Moreover, the gear ratio control unit 22 changes, when satisfying a predetermined condition, the gear ratio of the automatic transmission 3 to a gear-ratio side (hereinafter, referred to as a slow-speed running side) used in a slow speed running. For example, the electronically controlled valve opening degree control unit 21 and the gear ratio control unit 22 are implemented by performing a program.

Figure 3:
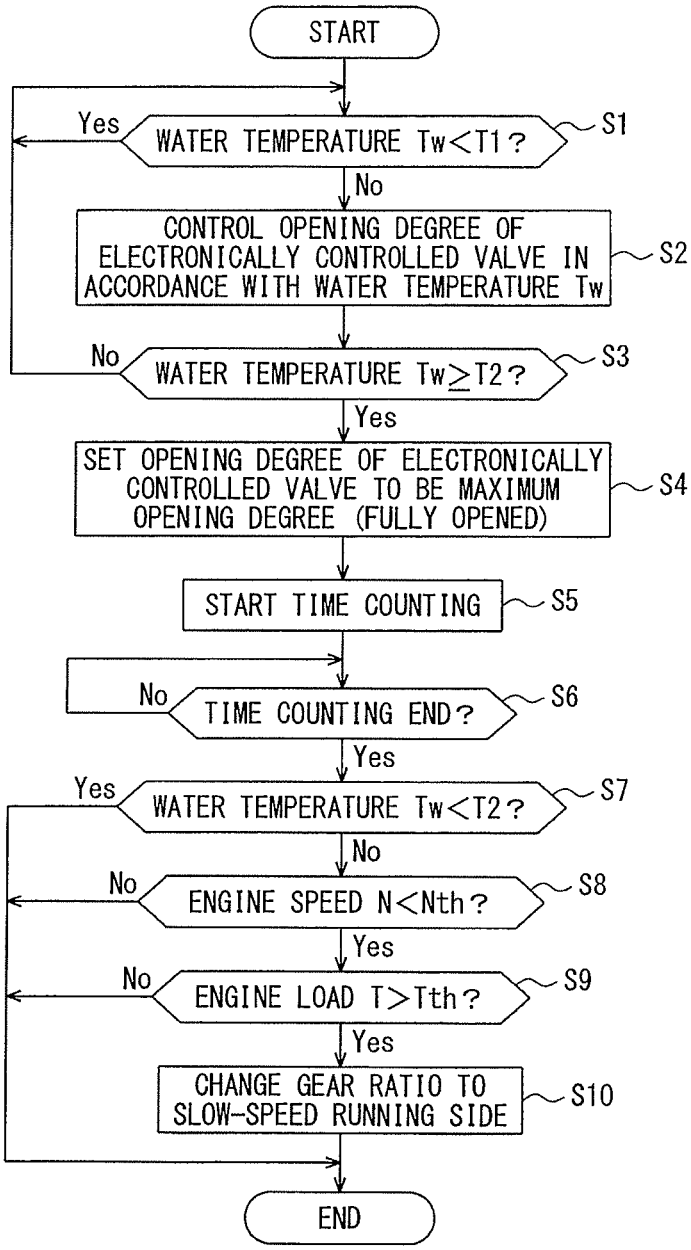
FIG. 3 is a flowchart illustrating an example of a process carried out by the ECU.

FIG. 3 is a flowchart illustrating an example of a process carried out by the ECU 20 having the above-explained configuration. The process carried out by each part of the ECU 20 will be explained in more detail while explaining the process procedure illustrated in FIG. 3.

As illustrated in FIG. 3, firstly, the electronically controlled valve opening degree control unit 21 determines in step S1 whether or not the water temperature (i.e., the temperature of the engine coolant) Tw detected by the water temperature detecting unit 5 is lower than a first water temperature determination threshold T1. Herein, the first water temperature determination threshold T1 is a value for determining an adjustment start timing of the opening degree of the electronically controlled valve 9. The first water temperature determination threshold T1 is a preset value, which is set, for example, experimentally, empirically, or theoretically. When determining that the water temperature Tw is equal to or higher than the first water temperature determination threshold T1 (Tw≥T1), the electronically controlled valve opening degree control unit 21 progresses the process to step S2.

In step S2, the electronically controlled valve opening degree control unit 21 controls the opening degree of the electronically controlled valve 9 in accordance with the water temperature Tw. More specifically, the higher the water temperature Tw is, the more the electronically controlled valve opening degree control unit 21 increases the opening degree of the electronically controlled valve 9.

Figure 4:
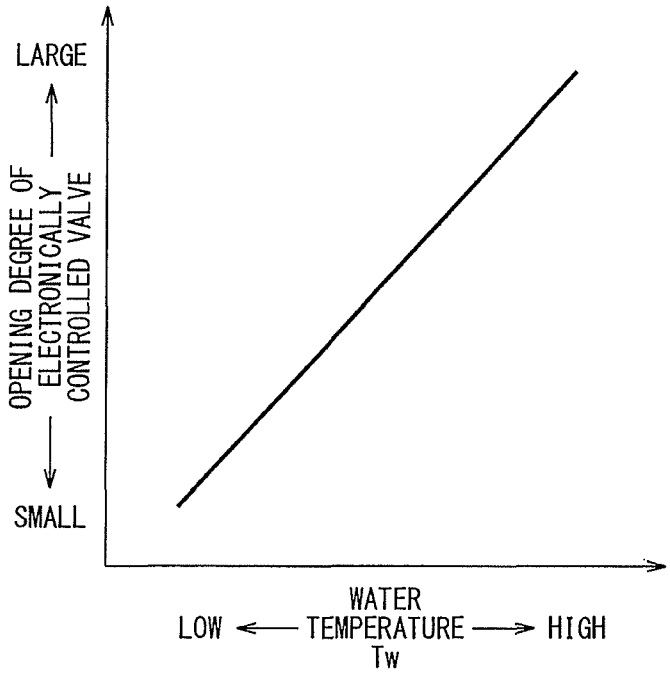
FIG. 4 is a diagram illustrating an example of relationship between a water temperature Tw and an opening degree of an electronically controlled valve.

FIG. 4 is a diagram illustrating an example of relationship between the water temperature Tw and the opening degree of the electronically controlled valve 9. As illustrated in FIG. 4, the higher the water temperature Tw is, the larger the opening degree of the electronically controlled valve 9 becomes. The electronically controlled valve opening degree control unit 21 refers to such a table illustrated in FIG. 4, and controls the opening degree of the electronically controlled valve 9 in accordance with the water temperature Tw.

Next, in step S3, the electronically controlled valve opening degree control unit 21 determines whether or not the water temperature Tw is equal to or higher than a second water temperature determination threshold T2. The second water temperature determination threshold T2 is a preset value, and is larger than the first water temperature determination threshold T1 (T2>T1). For example, the second water temperature determination threshold T2 is a value set to be lower than a water temperature (corresponding to an engine temperature) Tmax at which the engine 2 highly possibly causes an abnormal combustion. That is, the second water temperature determination threshold T2 is a water temperature that can prevent an internal combustion engine from reaching a water temperature range where such an internal combustion engine highly possibly causes an abnormal combustion. The second water temperature determination threshold T2 is set, for example, experimentally, empirically, or theoretically. When determining that the water temperature Tw is equal to or higher than such a second water temperature determination threshold T2 (Tw≥T2), the electronically controlled valve opening degree control unit 21 progresses the process to step S4. Conversely, when determining that the water temperature Tw is lower than the second water temperature determination threshold T2 (Tw<T2), the electronically controlled valve opening degree control unit 21 starts the process from the step S1 again.

In step S4, the electronically controlled valve opening degree control unit 21 causes the opening degree of the electronically controlled valve 9 to be the maximum opening degree (fully opened).

Next, in step S5, the ECU 20 (e.g., the electronically controlled valve opening degree control unit 21) starts counting a time.

Subsequently, in step S6, the ECU 20 (e.g., the electronically controlled valve opening degree control unit 21) determines whether or not the time counting ends. More specifically, the ECU 20 determines whether or not the counted time reaches a count end value. The count end value is a preset value. The count end value is set, for example, experimentally, empirically, or theoretically. When determining that the time count ends, the ECU 20 progresses the process to step S7.

In step S7, the gear ratio control unit 22 determines whether or not the water temperature Tw is lower than the second water temperature determination threshold T2. When determining that the water temperature Tw is lower than the second water temperature determination threshold T2 (Tw<T2), the gear ratio control unit 22 terminates the process illustrated in FIG. 4. Conversely, when determining that the water temperature Tw is equal to or higher than the second water temperature determination threshold T2 (Tw≥T2), the gear ratio control unit 22 progresses the process to step S8.

The opening degree of the electronically controlled valve 9 is set to be the maximum opening degree (fully opened) when the water temperature Tw is the second water temperature determination threshold T2. Hence, in this step S7, the gear ratio control unit 22 determines whether or not the water temperature Tw is equal to or higher than the second water temperature determination threshold T2 that is a set value when the opening degree of the electronically controlled valve 9 is the maximum opening degree (fully opened).

In step S8, the gear ratio control unit 22 determines whether or not an engine speed N detected by the engine speed detecting unit 6 is slower than an engine speed determination threshold Nth. The engine speed determination threshold Nth is an engine speed at which the engine 2 highly possibly causes an abnormal combustion. The engine speed determination threshold Nth is a preset value, which is set, for example, experimentally, empirically, or theoretically. When determining that the engine speed N is lower than the engine speed determination threshold Nth (N<Nth), the gear ratio control unit 22 progresses the process to step S9. Conversely, when determining that the engine speed N is equal to or higher than the engine speed determination threshold Nth (N≥Nth), the gear ratio control unit 22 terminates the process illustrated in FIG. 4.

In step S9, the gear ratio control unit 22 determines whether or not an engine load T detected by the load detecting unit 7 is larger than an engine load determination threshold Tth. The engine load determination threshold Tth is an engine load at which the engine 2 highly possibly causes an abnormal combustion. The engine load determination threshold Tth is a preset value, which is set, for example, experimentally, empirically, or theoretically. When determining that the engine load T is larger than the engine load determination threshold Tth, the gear ratio control unit 22 progresses the process to step S10. Moreover, when determining that the engine load T is equal to or smaller than the engine load determination threshold Tth, the gear ratio control unit 22 terminates the process illustrated in FIG. 4.

In step S10, the gear ratio control unit 22 changes the gear ratio of the automatic transmission 3 to the slow-speed running side. Next, the gear ratio control unit 22 terminates the process illustrated in FIG. 4.

Herein, the gear ratio changed to the slow-speed running side is, more specifically, a gear ratio which increases the engine speed so that a desired output generated by the engine 2 while suppressing an abnormal combustion. For this purpose, the gear ratio control unit 22 detects a desired output generated by the engine 2 based on the accelerator opening degree detected by the accelerator opening degree detecting unit 8, and calculates an intake air amount and an engine speed which do not cause an abnormal combustion based on the water temperature. Next, the gear ratio control unit 22 calculates an increased amount of the engine speed based on the detected and calculated values, and determines the gear ratio that can obtain the calculated increased amount of the engine speed as the gear ratio to be changed to the slow-speed running side.

When the automatic transmission 3 is a CVT, the ECU 20 changes the pulley ratio to shift the gear ratio to the slow-speed running side.

Operation and Action, etc.

Next, an explanation will be given of an operation, an action, etc., of the vehicle 1 according to the present embodiment.

When the water temperature Tw becomes equal to or higher than the first water temperature determination threshold T1, the ECU 20 starts controlling the opening degree of the electronically controlled valve 9 in accordance with the water temperature Tw. At this time, the higher the water temperature Tw is, the larger the ECU 20 increases the opening degree of the electronically controlled valve 9 (steps S1 and S2). Hence, the flow rate of the engine coolant cooled down by the radiator 4 increases, and the flow rate of the engine coolant flowing through the engine 2 increases.

When the water temperature Tw becomes equal to or higher than the second water temperature determination threshold T2 (the second water temperature determination threshold T2>the first water temperature determination threshold T1), the ECU 20 sets the opening degree of the electronically controlled valve 9 to be the maximum opening degree (fully opened), and counts a time while the opening degree of the electronically controlled valve 9 is being set to be the maximum opening degree (steps S3 to S5).

Thereafter, when the time counting ends, the water temperature Tw is still higher than the second water temperature determination threshold T2, the engine speed is slow, and the engine load is high, the ECU 20 changes the gear ratio of the automatic transmission 3 to the slow-speed running side (steps S6 to S10).

Since the ECU 20 operates as described heretofore, the electronically controlled valve 9 gradually opens as the water temperature Tw increases after the water temperature Tw reaches the first water temperature determination threshold T1, and is fully opened when the water temperature Tw reaches the second water temperature determination threshold T2. Accordingly, when the water temperature Tw exceeds the first water temperature determination threshold T1, the vehicle 1 can lower the water temperature Tw (suppress the water temperature Tw from increasing), and can lower the engine temperature. As a result, this allows the vehicle 1 to avoid a high water temperature condition (i.e., a condition in which the engine temperature is high) in which the engine 2 highly possibly causes an abnormal combustion, thereby suppressing an abnormal combustion.

In addition, even if the opening degree of the electronically controlled valve 9 is controlled as explained above, in a case where the water temperature Tw is continuously equal to or higher than the second water temperature determination threshold T2, the gear ratio is changed to the slow-speed running side on condition that the engine speed is low and the engine load is large. This allows the vehicle 1 to increase the engine speed and to suppress an abnormal combustion.

An example operation of the ECU 20, etc. will now be explained with reference to FIG. 5.

Figure 5:
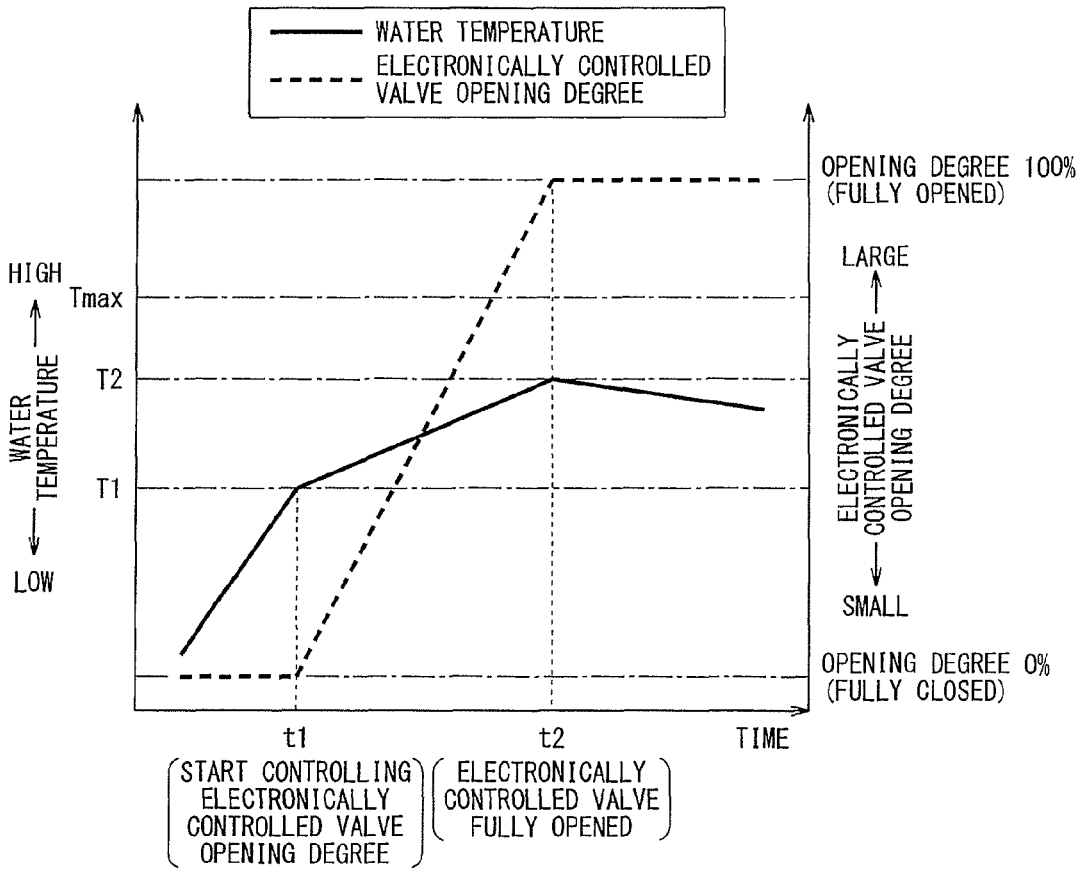
FIG. 5 is a diagram for explaining an operation example by the ECU, etc.

FIG. 5 represents a relationship between the water temperature Tw and the opening degree of the electronically controlled valve 9. FIG. 5 also illustrates a water temperature (hereinafter, referred to as an upper-limit temperature) Tmax at which the engine 2 highly possibly causes an abnormal combustion.

As illustrated in FIG. 5, the ECU 20 starts controlling the opening degree of the electronically controlled valve 9 in accordance with the water temperature Tw when the water temperature Tw becomes equal to or higher than the first water temperature determination threshold T1 (a time t1). In the example illustrated in FIG. 5, the water temperature Tw is rising after the time t1, and thus the ECU 20 increases the opening degree of the electronically controlled valve 9 in accordance with the water temperature Tw that is rising in such a manner.

Next, as illustrated in FIG. 5, when the water temperature Tw keeps rising although the opening degree of the electronically controlled valve 9 is increased, the ECU 20 sets the electronically controlled valve 9 to be fully opened when the water temperature Tw reaches the second water temperature determination threshold T2 (time t2). In the example case illustrated in FIG. 5, by causing the electronically controlled valve 9 to be fully opened, the water temperature Tw does not rise toward the upper-limit temperature Tmax and falls down from the second water temperature determination threshold T2. Accordingly, the temperature of the engine 2 falls down, thereby suppressing a situation in which the engine 2 highly possibly causes an abnormal combustion.

Moreover, according to the above-explained embodiment, the electronically controlled valve 9 constitutes, for example, a flow rate adjusting unit. The electronically controlled valve opening degree control unit 21 constitutes, for example, an opening degree adjusting unit. The gear ratio control unit 22 constitutes, for example, a gear ratio changing unit. Furthermore, the electronically controlled valve 9 and the electronically controlled valve opening degree control unit 21 constitute, for example, a combustion state control apparatus.

Modification to Embodiment

According to the embodiment of the present invention, the automatic transmission 3 may include multiple transmission mechanisms. An example automatic transmission 3 including multiple transmission mechanisms is an automatic transmission 3 with a sub-transmission. The automatic transmission 3 with a sub-transmission includes a main transmission mechanism and a sub-transmission that is another transmission mechanism, and is capable of expanding the variation range of the gear ratio by changing respective gear ratios of the transmission mechanisms. As an example, the sub-transmission is a transmission mechanism having two stages of the gear ratios including: a fast-speed running gear (HIGH gear); and a slow-speed running gear (LOW gear). The sub-transmission having such a configuration changes the gear from the fast-speed running gear to the slow-speed running gear, so as to increase the engine speed.

According to the present embodiment, when the automatic transmission 3 includes multiple transmission mechanisms, the gear ratio of one of the transmission mechanisms can be set to the slow-speed running side, so that respective gear ratios of the transmission mechanisms can be set to the slow-speed running side. According to the present embodiment, when the automatic transmission 3 includes multiple transmission mechanisms, respective gear ratios of multiple transmission mechanisms can be set to the slow-speed running side, and thus the gear ratio of the whole automatic transmission 3 can be changed within a further wider range. Hence, according to the present embodiment, it becomes possible to increase the engine speed further largely, thereby suppressing an abnormal combustion.

The embodiment of the present invention has been explained in detail, but the present invention is not limited to the exemplified embodiment illustrated and explained above, and all embodiments that can derive the equivalent advantages to the object of the present invention are included within the scope and spirit of the present invention. The scope and spirit of the present invention are not limited to the combination of the features of the present invention set forth in appended claims, but should be interpreted within the broadest scope and spirit of the present invention that include all desired combinations of particular features among the features disclosed herein.

REFERENCE SIGNS LIST

1 Vehicle
2 Engine
3 Automatic transmission
4 Radiator
5 Water temperature detecting unit
6 Engine speed detecting unit
7 Load detecting unit
8 Accelerator opening degree detecting unit
9 Electronically controlled valve
20 ECU
21 Electronically controlled valve opening degree control unit
22 Gear ratio control unit

The invention claimed is:

1. A combustion state control apparatus for controlling a combustion state of an internal combustion engine of a vehicle having the internal combustion engine, an automatic transmission capable of automatically changing a gear ratio, a radiator in which a coolant flowing through the internal combustion engine is to circulate to lower a temperature of the coolant, a flow rate adjusting unit for adjusting a flow rate of the coolant to the radiator, a coolant temperature detecting unit for detecting the temperature of the coolant, an engine speed detecting unit for detecting an engine speed of the internal combustion engine, and a load detecting unit for detecting a load of the internal combustion engine, the combustion state control apparatus comprising:

an opening degree adjusting unit configured to increase an opening degree of the flow rate adjusting unit, as the temperature of the coolant detected by the coolant temperature detecting unit rises; and a gear ratio changing unit configured to change the gear ratio of the automatic transmission to a gear ratio to be used when the vehicle runs at a slow speed, and to change to said gear ratio when all of the following conditions are present:

the temperature of the coolant detected by the coolant temperature detecting unit when the opening degree adjusting unit sets the opening degree of the flow rate adjusting unit to a maximum opening degree is equal to or higher than a threshold temperature, the engine speed of the internal combustion engine detected by the engine speed detecting unit is slower than a preset engine speed, and the load on the internal combustion engine detected by the load detecting unit is larger than a preset load.

2. The combustion state control apparatus according to claim 1, wherein the automatic transmission comprises a plurality of transmission mechanisms, and the gear ratio changing unit is configured to change respective gear ratios of the plurality of transmission mechanisms to gear ratios to be used when the vehicle runs at the slow speed.

3. The combustion state control apparatus according to claim 1, wherein the threshold temperature is less than a temperature that was predetermined to cause a high risk of engine knocking.

4. The combustion state control apparatus according to claim 3, wherein the preset engine speed is an engine speed that was predetermined to cause the high risk of engine knocking, and wherein the preset engine load is an engine load that was predetermined to cause the high risk of engine knocking.

5. The combustion state control apparatus according to claim 1, wherein the threshold temperature is a higher threshold temperature, and wherein the opening degree adjusting unit is configured to:

increase the opening degree of the flow rate adjusting unit in response to determining that the coolant temperature is above a lower threshold temperature, and set the opening degree to the maximum opening degree in response to determining that the coolant temperature is equal to or above than the higher threshold temperature.

6. The combustion state control apparatus according to claim 5, wherein the gear ratio changing unit is configured to change the gear ratio only when the temperature of the coolant has been equal to or above the higher threshold temperature for a preset amount of time.

7. The combustion state control apparatus according to claim 1, wherein the gear ratio changing unit is configured to:

calculate an air intake amount;

calculate, based on the coolant temperature, an engine speed that does not cause a high risk of engine knocking;

calculate an amount of engine speed increase based on the calculated air intake amount and the calculated engine speed; and determine a gear ratio that obtains the amount of engine speed increase.

* * * * *